US008256866B2

(12) United States Patent
Maru et al.

(10) Patent No.: US 8,256,866 B2
(45) Date of Patent: Sep. 4, 2012

(54) INK JET RECORDING APPARATUS AND INK JET RECORDING METHOD

(75) Inventors: Akiko Maru, Tokyo (JP); Manabu Yamazoe, Tokyo (JP); Satoshi Seki, Kawasaki (JP); Mitsuhiro Ono, Tokyo (JP); Atsuhiko Masuyama, Yokohama (JP); Hiroshi Tajika, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 259 days.

(21) Appl. No.: 12/868,155

(22) Filed: Aug. 25, 2010

(65) Prior Publication Data

US 2011/0050779 A1 Mar. 3, 2011

(30) Foreign Application Priority Data

Sep. 1, 2009 (JP) ..... 2009-201476

(51) Int. Cl.
*B41J 29/38* (2006.01)

(52) U.S. Cl. ..... 347/16

(58) Field of Classification Search ..... 347/7, 16, 347/101, 104

See application file for complete search history.

(56) References Cited

U.S. PATENT DOCUMENTS

| | | | | |
|---|---|---|---|---|
| 7,204,572 | B2 * | 4/2007 | Seki et al. | 347/16 |
| 7,578,570 | B2 * | 8/2009 | Seki et al. | 347/16 |
| 2005/0073535 | A1 | 4/2005 | Seki | |

FOREIGN PATENT DOCUMENTS

JP 2005-125750 A 5/2005

* cited by examiner

*Primary Examiner* — An Do

(74) *Attorney, Agent, or Firm* — Canon USA, Inc., IP Division

(57) ABSTRACT

There is provided an ink jet recording apparatus capable of shortening the recording duration even when an image to be recorded includes a high-duty area having a large amount of ink to be discharged in the case of two-sided recording on a recording medium. The ink jet recording apparatus, which reverses the recording medium to enable two-sided recording, performs dividing the image to be recorded on a high-duty area having a large amount of ink to be discharged into two (first and second) planes, first plane recording involving a unit area to be subjected to an ink discharge amount below a predetermined amount, reversing the recording medium, and recording on the rear surface, and reversing the recording medium again, and second plane recording.

7 Claims, 12 Drawing Sheets

FIG. 7

| DISTANCE FROM TRAILING EDGE | RECORDING MEDIUM | |
|---|---|---|
| | SHEET A | SHEET B |
| LESS THAN 5 CM | 8000 | 8500 |
| 5 CM TO 15 CM (EXCLUSIVE) | 9000 | 9500 |
| 15 CM OR MORE | 10000 | 10500 |

UNIT: NUMBER OF DOTS

FIG. 10

| | | EXAMPLE OF CONVENTIONAL METHOD | EXAMPLE OF NEW METHOD A | EXAMPLE OF NEW METHOD B |
|---|---|---|---|---|
| | | CONVENTIONAL TWO-SIDED RECORDING | ONE-SIDED DIVISION RECORDING | TWO-SIDED DIVISION RECORDING |
| STEP B1 | FEED SHEET | 2.5 | 2.5 | 2.5 |
| STEP B2 | PRINT | 8 | 4.5 | 4.5 |
| STEP B3 | WAIT FOR DRYING | 12 | 0 | 0 |
| STEP B4 | REVERSE RECORDING MEDIUM | 4 | 4 | 4 |
| STEP B5 | PRINT | 8 | 8 | 4.5 |
| STEP B6 | WAIT FOR DRYING | — | 0 | 0 |
| STEP B7 | REVERSE RECORDING MEDIUM | — | 4 | 4 |
| STEP B8 | PRINT | — | 4.5 | 4.5 |
| STEP B9 | WAIT FOR DRYING | — | — | 0 |
| STEP B10 | REVERSE RECORDING MEDIUM | — | — | 4 |
| STEP B11 | PRINT | — | — | 4.5 |
| | TOTAL RECORDING TIME | 34.5 | 27.5 | 32.5 |

UNIT: SECONDS [sec]

INK JET RECORDING APPARATUS AND INK JET RECORDING METHOD

BACKGROUND OF THE INVENTION

1. Field of the Invention

The disclosed information relates to an ink jet recording apparatus, which discharges ink from a recording head to perform recording on a recording medium, and to an ink jet recording method therefor. The disclosed information particularly relates to an ink jet recording apparatus for two-sided recording on a recording medium, and to an ink jet recording method therefor.

2. Description of the Related Art

Generally known recording apparatuses applied to printers, copying machines, and facsimiles record an image formed of dot patterns on a recording medium such as paper and a plastic thin plate based on recording information. Methods for recording an image formed of dot patterns include the ink jet method, wire dot method, thermal method, and laser beam method. Among these, the ink jet method discharges ink drops (recording liquid) from a discharge port of a recording head to the recording medium, and then fixes the ink thereon. This method has a benefit of a comparatively low price.

The ink jet method has a problem of the occurrence of stain, called smear, and other image failures. Since the ink jet method uses ink composed of waterborne liquid, it is necessary to volatilize moisture contained therein. Specifically, the ink jet method requires a time duration necessary for ink to dry and for the recorded image to fix (hereinafter, referred to as ink drying time).

However, when a second recording medium is discharged and placed onto a previously discharged, first recording medium having ink that has not fully dried (hereinafter, referred to as semi-dry ink) thereon, ink from the first recording medium may adhere to the rear surface of the just discharged second recording medium. In this case, the rear surface of the subsequently discharged, second recording medium will degrade the image recorded on the previously discharged, first recording medium, causing smear on the rear surface of the second recording medium. When a recording area has a high recording ratio, a large ink discharge amount prolongs the ink drying time and makes smear more likely to occur.

With an ink jet recording apparatus that performs two-sided recording on a recording medium, a secondary smear may occur. With such an ink jet recording apparatus having the two-sided recording function, recording is made on a first surface of the recording medium and then the recording medium is fed to a reversing conveyance path. Then, the recording medium is reversed and then recording is made on the other, second surface.

In this case, when the recording medium is fed to the reversing conveyance path before ink has fully dried, semi-dry ink grazes in the reversing conveyance path, resulting in degraded image or smear. In addition to smear, secondary smear occurs. Specifically, ink adhering to the conveyance path stains the following recording medium passing therethrough.

Japanese Patent Application Laid-Open No. 2005-125750 discusses a technique that attempts to address this. The technique includes dividing an area corresponding to one surface of a recording medium into multiple areas, setting an ink drying time according to the amount of ink to be discharged to each unit area, and performing recording on one surface (front surface) of the recording medium. After the ink drying time has elapsed, the recording medium is fed to the reversing conveyance path and recording is performed on the other surface (rear surface) of the recording medium.

However, when performing two-sided recording with the technique discussed in Japanese Patent Application Laid-Open No. 2005-125750 in a situation where there exists a high-duty area having a large ink discharge amount on the surface previously recorded, it is necessary to set an ink drying time that is long enough to prevent smear, even when the recording medium is fed again to the reversing conveyance path. Therefore, this technique has a problem that two-sided recording takes additional time.

SUMMARY OF THE INVENTION

The disclosed information is directed to an ink jet recording apparatus to shortening the duration required for two-sided recording while preventing image failure caused by smear due to semi-dry ink adhering to the inside of the conveyance path, and image failure caused by secondary smear due to ink adhering to the conveyance path.

According to an aspect of the disclosed information, an ink jet recording apparatus for two-sided recording discharges ink from a recording head to first and second surfaces of a recording medium. The ink jet recording apparatus includes a conveyance unit, a determination unit, and a control unit. The conveyance unit may convey the recording medium to reverse front and rear surfaces of the recording medium to allow the two-sided recording. The determination unit may determine, for each unit area formed by dividing the first surface into multiple unit areas, whether an amount of ink to be discharged to each unit area is equal to or greater than a predetermined amount. The control unit may control the conveyance unit and the recording head to discharge to a unit area an amount of ink below the predetermined amount corresponding to a part of the amount of ink to be discharged to the unit area. Here, the unit area receiving the ink is a unit area determined to be subjected to an ink discharge amount equal to or greater the predetermined amount by the determination unit. The control unit further controls the conveyance unit and the recording head to move the recording medium reversely so that the second surface faces the recording head. The control unit additionally controls the conveyance unit and the recording head to move the recording medium reversely. The control unit also controls the conveyance unit and the recording head to discharge a remaining part of the amount of ink to the unit area that has been subjected to an ink discharge amount below the predetermined amount.

According to the disclosed information, high-speed two-sided recording is achieved while preventing image failure due to semi-dry ink adhering to the inside of the conveyance path or to the following recording medium.

Further features and aspects of the disclosed information will become apparent from the following detailed description of examples with reference to the attached drawings.

BRIEF DESCRIPTION OF THE DRAWINGS

The accompanying drawings, which are incorporated in and constitute apart of the specification, illustrate examples, features, and aspects of the invention and, together with the description, serve to explain the principles of the disclosed information.

FIG. 7 illustrates a threshold value table used for determination of a high-duty area.

FIG. 10 is a table of durations required for two-sided recording.

DESCRIPTION OF THE EMBODIMENTS

Figure 1:
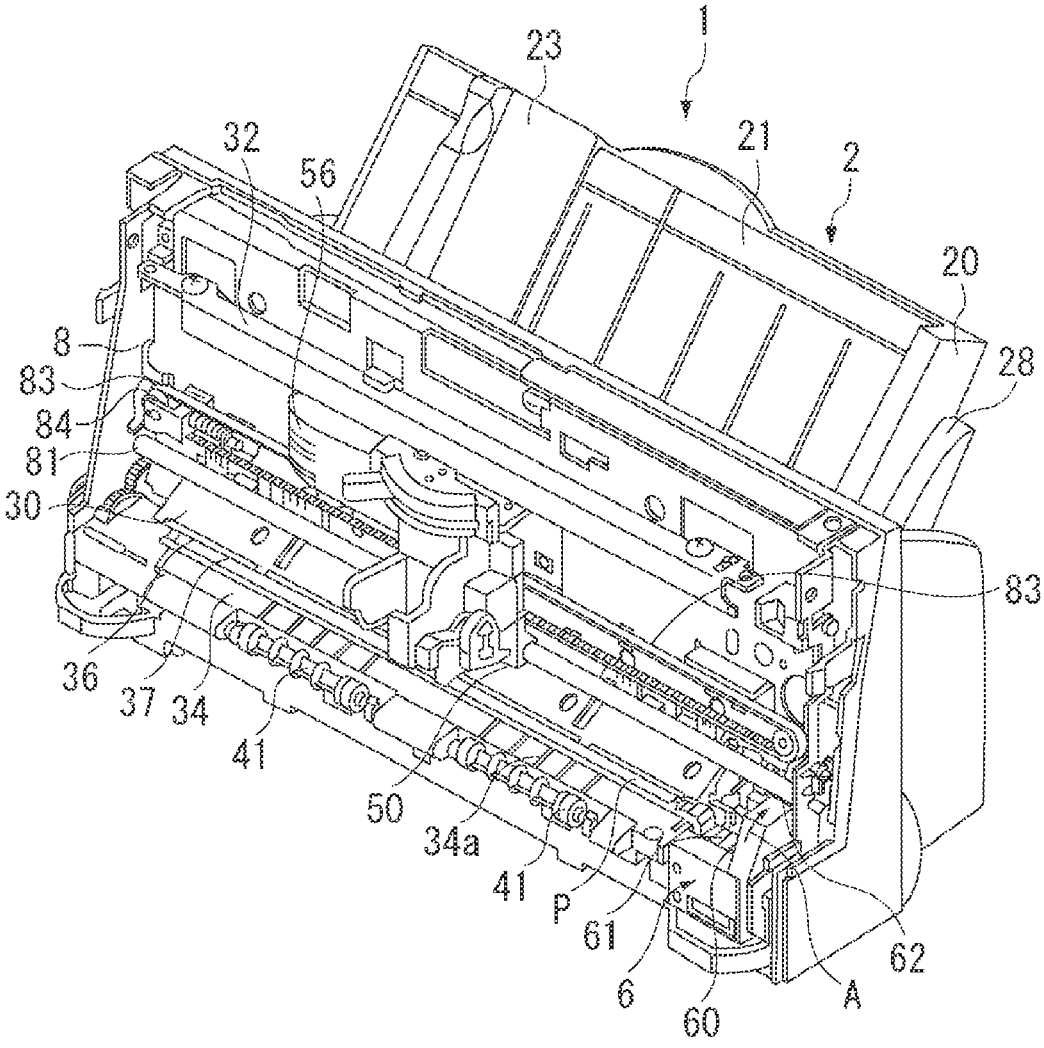
FIG. 1 is a perspective view illustrating an overall configuration of an ink jet recording apparatus.

Various examples, features, and aspects of the disclosed information will be described in detail below with reference to the drawings.

An overall configuration of an ink jet recording apparatus 1 will be described below with reference to FIGS. 1 to 3. The inkjet recording apparatus 1 mainly includes a sheet feeding unit 2, a sheet conveyance unit 3, a sheet discharge unit 4, a carriage unit 5, and a cleaning unit 6. Firstly, an overall configuration of each unit will be described in sections (I) to (VI) below.

Figure 2:
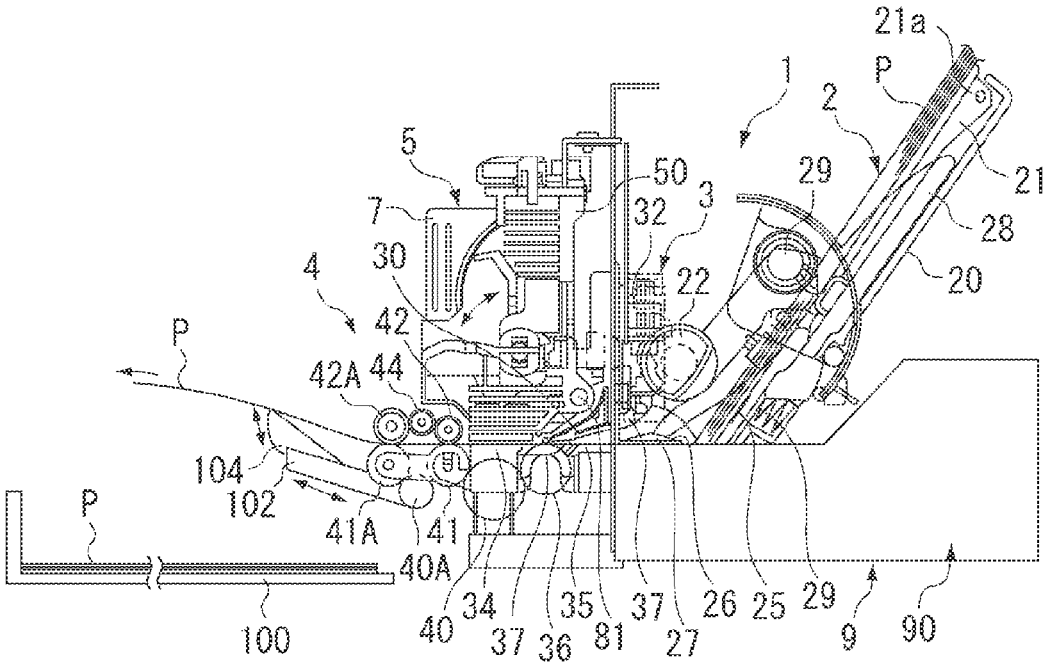
FIG. 2 is a longitudinal cross section of the inkjet recording apparatus.
Figure 3:
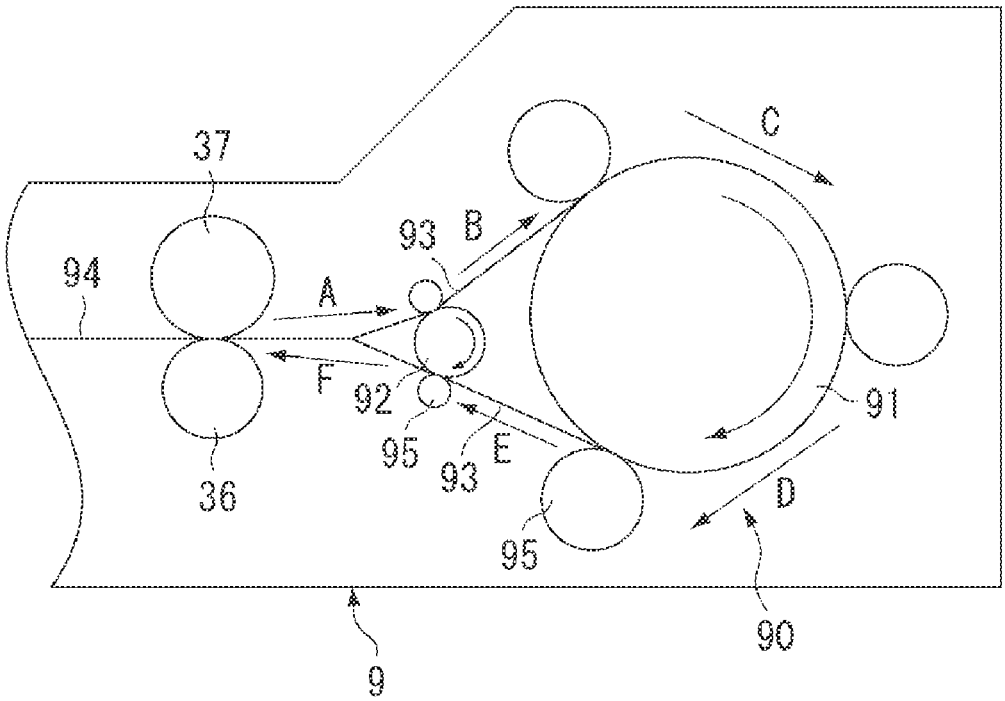
FIG. 3 is a side view illustrating an overall configuration of a recording medium reversing unit.

FIG. 1 illustrate an overall configuration of the ink jet recording apparatus 1, FIG. 2 illustrates a cross section of the ink jet recording apparatus 1 when viewed from a side face, and FIG. 3 illustrates a recording medium reversing unit 9 including a reversing unit 90. The sheet feeding unit 2, the sheet conveyance unit 3, the carriage unit 5, the cleaning unit 6, the sheet discharge unit 4, and the recording medium reversing unit 9 will be described in sections (I) to (VI), respectively, with reference to FIGS. 1 to 3.

(I) Sheet Feeding Unit

The sheet feeding unit 2 includes a pressing plate 21 for loading recording media P and a sheet feeding rotating member 22 for feeding a recording medium P, and a base 20 to which both the pressing plate 21 and the sheet feeding rotating member 22 are attached. A movable side guide 23 is movably disposed on the pressing plate 21 to restrain the loading position of the recording media P. The pressing plate 21 is rotatable centering on a rotating axis 21*a* connected to the base 20, and biased toward the sheet feeding rotating member 22 by a pressing plate spring 24. To prevent double feed of the recording media P, a separation pad 25 made of a material having a large friction coefficient, such as artificial leather, is disposed on a portion of the pressing plate 21 facing the sheet feeding rotating member 22.

Further, the base 20 is provided with a separating claw 26 covering a corner portion in one direction of the recording media P to separate each of the recording media P, and with a bank portion 27 integrally formed thereon to separate pasteboards that cannot be separated by the separating claw 26. The base 20 also is provided with a switching lever 28 for enabling the function of the separating claw 26 at the normal paper position and disabling it at the pasteboard position. The base 20 also is provided with a release cam 29 for releasing contact between the pressing plate 21 and the sheet feeding rotating member 22.

With the above-mentioned configuration, the release cam 29 presses the pressing plate 21 down to a predetermined position in the standby state. Therefore, contact between the recording media P loaded on the pressing plate 21 and the sheet feeding rotating member 22 is released. In this state, when the driving force of the conveyance roller 36 is transmitted to the sheet feeding rotating member 22 and the release cam 29 via a gear or the like, the release cam 29 separates from the pressing plate 21, the pressing plate 21 raises, and the sheet feeding rotating member 22 and the recording media P contact with each other.

Then, as the sheet feeding rotating member 22 rotates, a recording medium P is picked up and fed, separated one by one by the separating claw 26, and fed to the sheet conveyance unit 3. The sheet feeding rotating member 22 and the release cam 29 keep rotating until the recording medium P is fed to the sheet conveyance unit 3. When the recording medium P has been fed to the sheet conveyance unit 3, the action of the release cam 29 releases again the contact between the recording medium P and the sheet feeding rotating member 22, resulting in the standby state. In this state, the driving force from the conveyance roller 36 is interrupted.

(II) Sheet Conveyance Unit

The sheet conveyance unit 3 includes the conveyance roller 36 for conveying a recording medium P and a PE sensor 32. The conveyance roller 36 is provided with a pinch roller 37, which rotates following the conveyance roller 36. The pinch roller 37 is rotatably retained to a pinch roller guide 30, which is biased by a pinch roller spring 31. Thus, the pinch roller 37 is pressed onto the conveyance roller 36 to produce the force for conveying the recording medium P.

At the entrance of the sheet conveyance unit 3 to which the recording medium P is conveyed, an upper guide 33 and a platen 34 are disposed to guide the recording medium P. Further, the upper guide 33 is provided with a paper end (PE) sensor lever 35 for notifying a paper end sensor (PE sensor) 32 of the detection of a leading end of the recording medium P.

With the above-mentioned configuration, the recording medium P conveyed to the sheet conveyance unit 3 is guided by the platen 34, the pinch roller guide 30, and the upper guide 33 to be conveyed to a roller pair of the conveyance roller 36 and the pinch roller 37.

In this case, the PE sensor lever 35 is pushed by the leading end of the recording medium P to be rotated, and the PE sensor 32 detects the rotation. A control apparatus (described below) obtains the recording position of the recording medium P based on a detection signal from the PE sensor 32. The rotation of the roller pair of the conveyance roller 36 and the pinch roller 37 driven by a conveyance motor (not illustrated) conveys the recording medium P over the platen 34.

A recording head 7 is replaceably attached to a carriage 50 (described below), and an ink tank is detachably attached to the recording head 7. Further, the recording head 7 includes nozzles arranged thereon, where each nozzle includes an electrothermal conversion element such as a heater.

The electrothermal conversion element is driven to apply heat to ink to cause film boiling of ink. Pressure change due to growth or contraction of air bubbles at the time of film boiling discharges ink from the nozzles, thus forming an image on the recording medium P.

(III) Carriage Unit

The carriage unit 5 includes the carriage 50 to which the recording head 7 is replaceably attached. The carriage 50 is supported movably in the main scanning direction by a guide axis 81 extending in the main scanning direction perpendicular to the conveyance direction of the recording medium P (sub scanning direction), and a guide rail 82 maintaining a gap between the recording head 7 and the recording medium P.

The guide axis 81 and the guide rail 82 are attached to a chassis 8. A carriage motor 211 (not illustrated) attached to the chassis 8 drives the carriage 50 via a timing belt 83. A proper tension between idol pulleys 84 supports the timing belt 83. The carriage 50 is connects with a flexible substrate 56 for transmitting a head drive signal from an electric substrate 9 to the recording head 7.

When forming an image on a recording medium P with the above-mentioned configuration, the rotation of the roller pair of the conveyance roller 36 and the pinch roller 37 conveys the recording medium P in the sub scanning direction to move it to a recording position on the platen 34. At the same time, the carriage motor 211 drives the carriage 50 to move the recording head 7 to an image formation position on the recording medium P in the main scanning direction. Then, while the carriage 50 is moving in the main scanning direction according to a recording start command, the recording head 7 discharges ink to the recording medium P based on a signal from the electric substrate 9, thus forming an image.

When attaching or detaching the recording head 7 to/from the carriage 50 and when attaching or detaching the ink tank to/from the recording head 7, a user presses an operation key (not illustrated) to move the carriage 50 to a predetermined replacement position. Then, the user attaches or detaches the recording head 7 and the ink tank at the replacement position.

(IV) Cleaning Unit

The cleaning unit 6 includes a pump 60 for cleaning the recording head 7, a cap 61 for preventing the recording head 7 from drying, and a drive switching arm 62 for switching the destination of the rotational driving force of the conveyance roller 36 between the sheet feeding unit 2 and the pump 60.

At the time of other than feeding and cleaning, since the drive switching arm 62 fixes to a predetermined position a planet gear (not illustrated) rotating centering on the axial center of the conveyance roller 36, the driving force is transmitted neither to the sheet feeding unit 2 nor the pump 60.

Moving the carriage 50 to move the drive switching arm 62 in the direction denoted by an arrow. A causes the planet gear, and accordingly the planet gear (not illustrated), to become free to move according to the forward or reverse rotation of the conveyance roller 36. When the conveyance roller 36 rotates forward, the driving force is transmitted to the sheet feeding unit 2. When the conveyance roller 36 rotates reversely, the driving force is transmitted to the pump 60.

(V) Sheet Discharge Unit

The sheet discharge unit 4 includes two sheet discharge rollers 41 and 41A at different positions in the sub scanning directions, a transmission roller 40 contacting the conveyance roller 36 and the sheet discharge roller 41, and a transmission roller 40A contacting the sheet discharge roller 41 and the sheet discharge roller 41A. Therefore, the rotational driving force of the conveyance roller 36 is transmitted to the sheet discharge roller 41 via the transmission roller 40, and the rotational driving force of the sheet discharge roller 41 is transmitted to the sheet discharge roller 41A via the transmission roller 40A.

Further, spur rollers 42 and 42A contact the sheet discharge rollers 41 and 41A, respectively, to be driven thereby. A cleaning roller 44 rotatably contacts the spur rollers 42 and 42A. With the above configuration, the sheet discharge rollers 41 and 41*a* and the spur rollers 42 and 42*a* sandwich the recording medium P having an image formed thereon by the carriage unit 5. The rotation of each roller conveys the recording medium P to be discharged onto a discharge tray 85.

A discharge support 87 (described below) for supporting the recording medium P, which is discharged after printing, is disposed on the downstream side of the sheet discharge roller 41A. The discharge support 87 is rotatably attached to a guide member 86.

The guide member 86 is supported to be linearly movable between a projection position from the platen 34 and a retracting position on the platen 34. The discharge support 87 performs rotational operation in association with the movement of the guide member 86. A recording medium conveyance path ranging from the sheet feeding unit 2 to the discharge support 87 via the recording head 7 forms a first conveyance path.

(VI) Recording Medium Reversing Unit

The recording medium reversing unit 9 includes a sheet feeding conveyance path 94 communicating with the first conveyance path, the conveyance roller 36, and the reversing unit 90 disposed on the rear side of the ink jet recording apparatus 1 (on the right-hand side in FIG. 2). Here, the reversing unit 90 includes a sheet pressing roller 95, a small reversing roller 92, a loop-shaped reversing conveyance path 93, and a large reversing roller 91.

A motor can rotatably drive the conveyance roller 36 in the forward or reverse direction. The sheet feeding conveyance path 94 and the reversing conveyance path 93 form a second conveyance path. The reversing unit 90 is attachable to the ink jet recording apparatus 1.

At the time of automatic two-sided recording, the conveyance roller 36 is rotated forward to feed the recording medium. P in the forward direction, and recording is made on one surface (also referred to as first surface) of the recording medium P fed from the sheet feeding unit 2. Then, the conveyance roller 36 is reversely rotated to feed the recording medium P at the sheet feeding conveyance path 94 to the reversing conveyance path 93, and the front-back sides of the recording medium P are reversed.

Specifically, as illustrated in FIG. 3, the recording medium P passes through the reversing conveyance path 93 in order of arrows A, B, C, D, E, F, and G so that the front-back sides of the recording medium P are reversed. Then, the reversed recording medium P is fed again to the platen 34 via the sheet feeding conveyance path 94, and the recording head 7 makes a recording on the other surface (also referred to as second surface).

Figure 4:
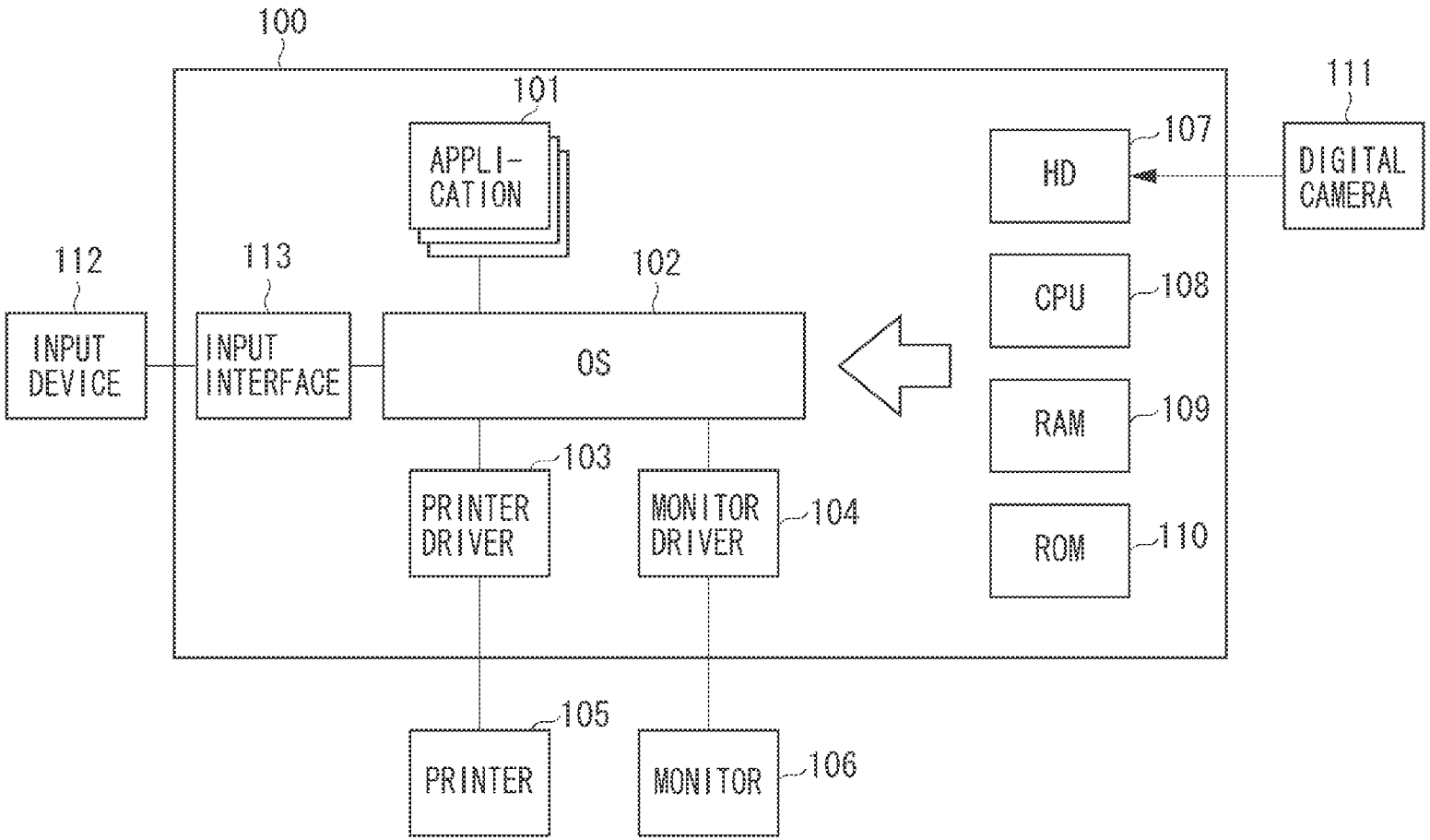
FIG. 4 is a block diagram illustrating an overall configuration of a printing system.

Processing for generating record data will be described below. FIG. 4 is a block diagram illustrating an overall configuration of record data generation according to an example of the disclosed information. The present system includes a host computer 100, an ink jet printer 105, and a monitor 106. Specifically, the ink jet printer 105 and the monitor 106, each of which is capable of bidirectional communication with the host computer 100, are connected to the host computer 100.

The host computer 100 includes an operating system (OS) 102, applications 101, a printer driver 103, and a monitor driver 104. The applications 101 include a word processor, a spreadsheet, an image processor, an Internet browser, and so on executed under control of the OS 102.

The printer driver 103 processes a group of various output image drawing commands (image drawing commands, text drawing commands, and graphic drawing commands) issued by the applications 101 to generate record data. The monitor driver 104 processes the group of various drawing commands issued by the applications 101 to display a target image on the monitor 106.

The host computer 100 includes a central processing unit (CPU) 108, a hard disk (HD) driver 107, a random access memory (RAM) 109, a read-only memory (ROM) 110, and an input interface 113 as hardware components operable by the above-mentioned application software. Specifically, the CPU 108 performs signal processing related to processing of the software. Image data captured by a digital camera 111 as well as the software are stored in a hard disk driven by the hard disk driver 107.

Similarly, various pieces of software prestored in the ROM 110 are loaded and executed as required. Further, the CPU 108 uses the RAM 109 as a work area for signal processing. User commands from the input device 112 such as a mouse and a keyboard are input via the input interface 113 and processed by the OS 102.

The system having the above configuration allows the user to generate image data based on an image displayed on the monitor 106 by using the applications 101. Through processing, the applications 101 classifies the generated image data into text data such as characters, graphic data such as figures, and image data such as natural images.

When the user instructs an application 101 to print the generated image data, the application 101 issues a print request to the OS 102. At the same time, the application 101 issues to the OS 102 a group of drawing commands for outputting an image, including graphic drawing commands for graphic data portion and image drawing commands for image data portion. Upon reception of the print request from the application 101, the OS 102 issues to the printer driver 103 a group of drawing commands corresponding to a printer that performs printing.

The printer driver 103 processes the print request and the group of drawing commands input from the OS 102, generates print data printable by the printer 105, and transmits the print data to the printer 105. In this case, when the printer 105 is a raster printer, the printer driver 103 successively performs image correction processing in response to the drawing commands from the OS 102 and successively rasterizes the drawing commands in a red, green, and blue (RGB) 24-bit page memory.

Upon completion of rasterization of all drawing commands, the printer driver 103 converts the contents of the RGB 24-bit page memory into a data format printable by the printer 105, for example, cyan, magenta, yellow, and key black (CMYK) data, and transmits the converted data to the printer 105.

Figure 5:
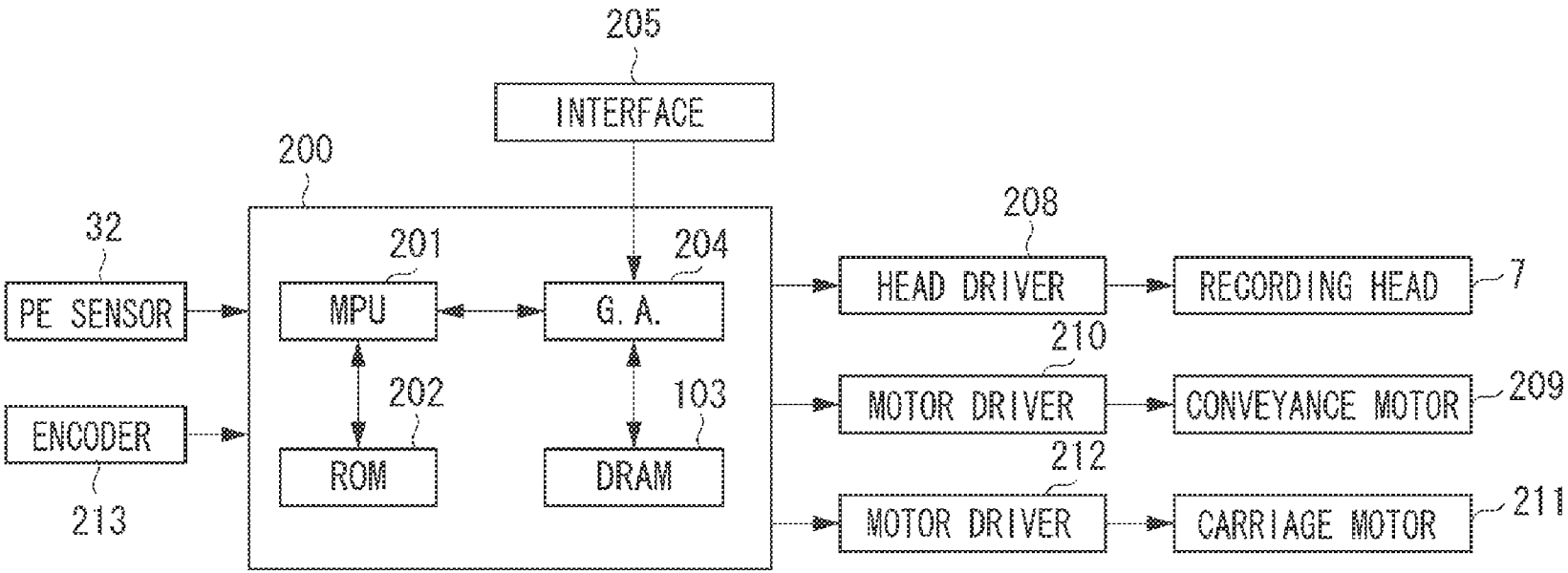
FIG. 5 is a block diagram schematically illustrating a configuration of a control system of the ink jet recording apparatus.

An outline configuration of a control system of the ink jet recording apparatus 1 will be described below with reference to FIG. 5. A control unit 200 controls each drive unit of the ink jet recording apparatus 1 according to the present example. The control unit 200 includes a microprocessor unit (MPU) 201, a ROM 202, a dynamic RAM (DRAM) 203, a gate array (GA) 204. The MPU 201 performs various calculation, determination, and control processing. The ROM 202 stores various programs executed by the MPU 201. The DRAM 203 serves not only as a temporary storage area for input data but also as a work area for calculation processing by the MPU 201.

An interface 205 for transmitting and receiving signals to/from external devices such as the host computer 100 illustrated in FIG. 4, is connected to the control apparatus 200. A signal input from the interface 205 is supplied to the MPU 201 and the DRAM 203 via the GA 204.

A head driver 208, motor drivers 210 and 212, an encoder 213, and the PE sensor 32 are connected to the control apparatus 200. The head driver 208 drives a heater disposed in each nozzle of the recording head 7. The motor driver 210 drives the conveyance motor 209, which rotatably drives the conveyance roller 36. The motor driver 212 drives the carriage motor 211, which drives the carriage 50. The encoder 213 detects the position of the carriage 50.

When the control system of the ink jet recording apparatus 1 receives record data from the host computer 100 via the interface 205, the record data is temporarily stored in the DRAM 203 via the GA 204. Then, the GA 204 converts the multivalued record data stored in the DRAM 203 into binary record data for recording by the recording head 7, and then the multivalued record data is stored again in the DRAM 203.

When the GA 204 retransmits the data to the recording head 7 via the head driver 208, a heater corresponding to the nozzle position is driven and heated to discharge the ink with thermal energy, where the discharged ink is used to record an image. In this case, a counter for counting the number of dots to be recorded is retained on the GA 204 to allow counting at high speed the number of dots recorded.

A two-sided recording method according to the disclosed information will be described below. At the time of two-sided recording, the recording medium reversing unit 9 should reverse the recording medium after completion of recording on one surface. In this case, however, when the recording medium is reversed before ink on one surface has not fully dried, ink will adhere to the conveyance path and cause image failure (smear). Further, ink adhering to the conveyance path may cause secondary smear, staining the following recording medium conveyed.

Particularly when the record data includes an area having a large ink discharge amount (a high-duty area), drying of ink takes time due to inferior fixing characteristics and the above-mentioned smear is likely to occur.

To solve this problem, in the disclosed information, it is determined for each unit area whether the record data includes a high-duty area having a large amount of ink to be discharged. When it is determined that the record data to be recorded on one surface involves a high-duty unit area to be subjected to an ink discharge amount equal to or greater than a predetermined amount, the record data to be recorded on the surface is divided into at least two pieces.

Recording on the surface by discharging an amount of ink below a predetermined amount, i.e., a part of the amount of ink to be recorded, is performed. At this timing, recording on the other surface is performed. Then, recording on the surface again by discharging the remaining amount of ink is performed. Thus, the recording duration is shortened while preventing smear due to unfixed ink.

Figure 6A:
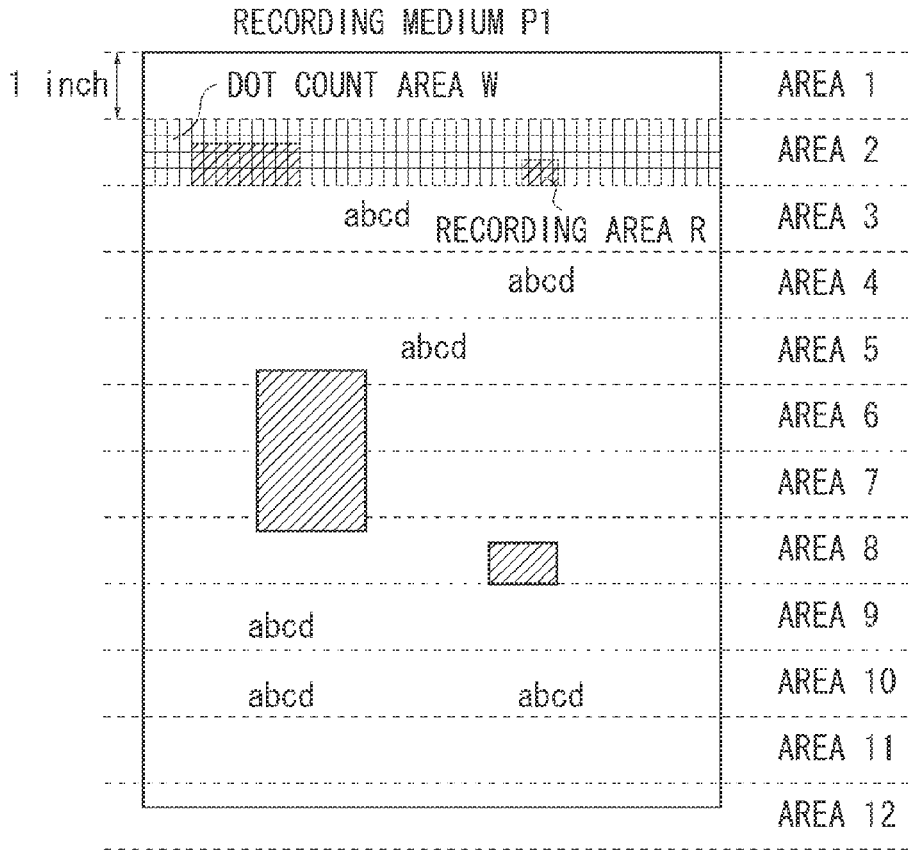
FIGS. 6A and 6B illustrate dot count areas.

A method for counting the number of dots used to determine whether there exists a high-duty area having a large amount of ink to be discharged in the present example will be described below with reference to FIGS. 6A and 6B. The processing acquires the number of dots recorded for each unit area recordable within a predetermined unit time. As illustrated in FIG. 6A, an area on the recording medium is divided into multiple unit areas (dot count areas W), and the number of dots to be recorded for each unit area is assumed to be the number of dots recorded per unit area.

In the present example, the motor driver 212 drives the carriage motor 211 to move the recording head 7 together with the carriage 50 in the main scanning direction in synchronization with the dot formation speed of the recording head 7. The MPU 200 performs interruption control to the GA 204 at predetermined intervals to read the integrated counter value of the number of dots recorded. This makes it possible to obtain information about the number of dots to be recorded in a unit area within a predetermined unit time.

FIG. 7 illustrates exemplary threshold values used to determine whether an area is a high-duty area. In the present example, when the amount of ink to be discharged to each unit area acquired by the above-mentioned dot count is equal to or greater than the predetermined amounts of ink illustrated in FIG. 7, the division recording of the record data is performed. In this case, since the ink fixing characteristics differ for each type of recording medium, the amount of ink to be discharged can be set according to the type of recording medium like sheets A and B of FIG. 7.

The time duration since the time when recording on one surface is completed until the time when the recording medium P is fed to the reversing conveyance path of the recording medium reversing unit 9 differs for each position on the recording medium P. Accordingly, the ink dryness depends on the position on the recording medium P. Specifically, the predetermined amount can be set according to the distance from an end (trailing end) of the surface of the recording medium P on which recording is made at the last half.

In the present example, different predetermined amounts of ink are set for three different ranges of distance from the trailing end of the recording medium P: 15 cm or more, 5 cm to 15 cm (exclusive), and less than 5 cm. These predetermined amounts of ink may be set for each ink type or for each combination of the distance and the ink type.

Figure 6B:
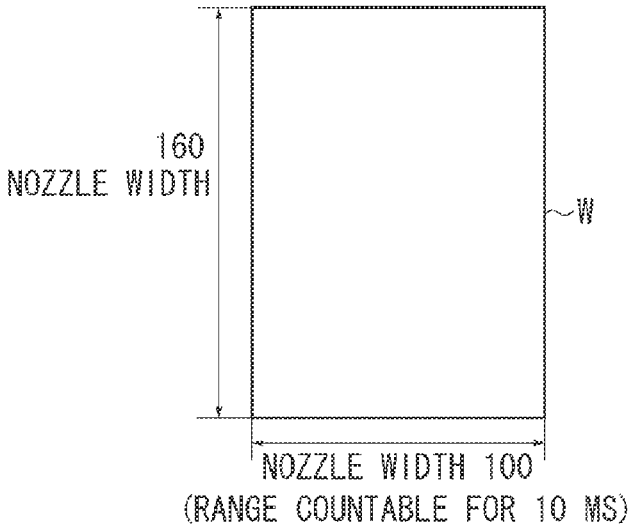

In the present example, as illustrated in FIG. 6B, a unit area is equivalent to an area on which recording is performed for 10 milliseconds by a recording head having a nozzle array width of 160 nozzles (10 milliseconds correspond to the 100-dot width in the main scanning direction when the recording head is driven by 10 kHz). In this case, the total number of dots in the unit area (a dot count area W) is 16000 (160×100). When the number of dots to be recorded in this area is equal to or greater than the predetermined values of FIG. 7, it is determined that the area is a high-duty area.

Further, determination of a high-duty area may be made not only by the number of dots but also by the recording ratio per unit area, according to formula (1):

$$\text{Recording ratio}=(\text{Actual number of dots recorded in unit area})/(\text{Number of recordable dots in unit area})\times 100 \quad (1)$$

Predetermined threshold values may be defined based on the recording ratio represented by formula (1). In the present example, since the number of recordable dots in the unit area is 16000, the recording ratio reaches 100% when 16000 dots are discharged to the unit area.

Figure 8C:
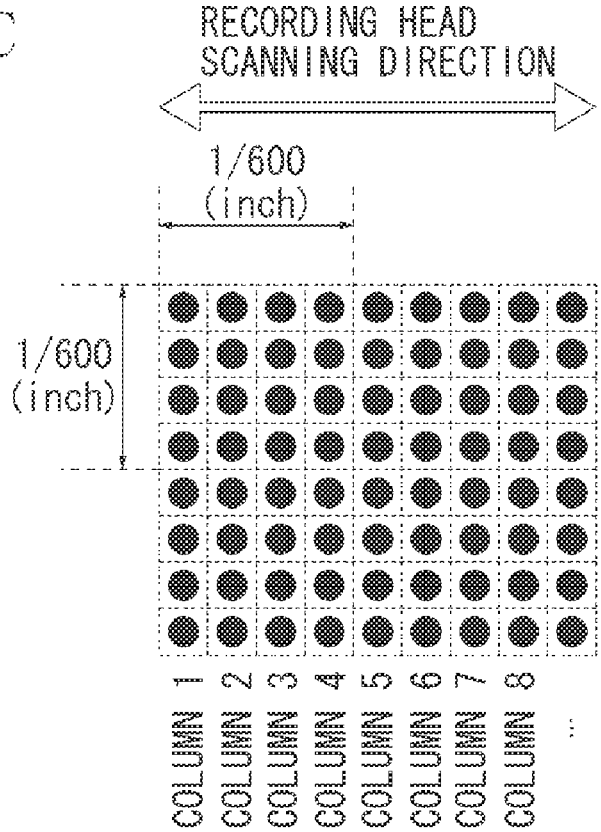
FIGS. 8A, 8B, and 8C illustrate an overall of a method for dividing record data.
Figure 8A:
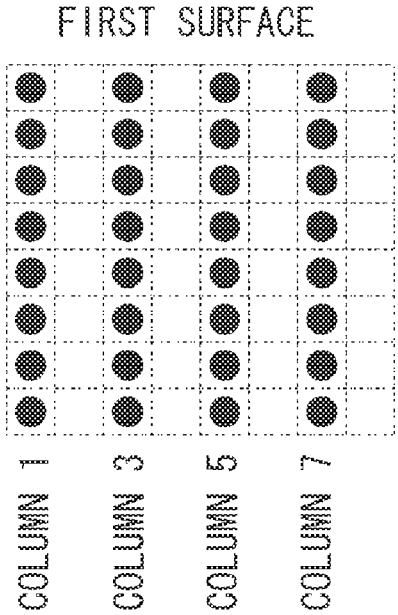
Figure 8B:
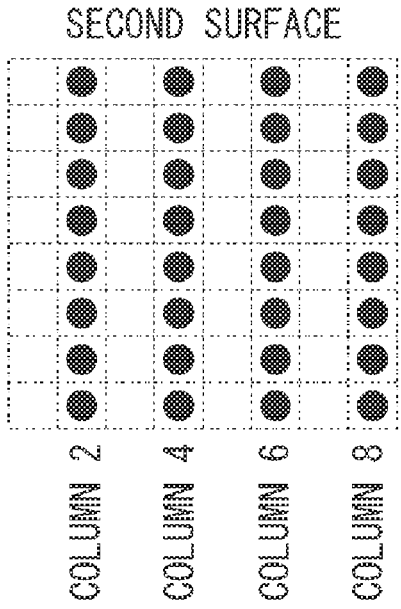

A method for dividing record data into multiple pieces of plane data to generate division record data will be described below with reference to FIGS. 8A, 8B, and 8C. The present example utilizes the column thinning-out method. FIGS. 8A, 8B, and 8C simply illustrate—ink drops impacted onto a recording medium. Ink drops are arranged with such a resolution that allows them to be impacted on the recording medium P.

A train of dots arranged vertically, i.e., in the direction perpendicular to the recording head scanning direction, is called a column. When columns are called a column 1, a column 2, a column 3, and so on from left to right, columns having an odd number form a first plane (FIG. 8A) and columns having an even number form a second plane (FIG. 8B). One surface can be divided into two planes in this way. After this division process, the impact distance in the recording head scanning direction between adjacent ink drops is twice that before division.

The distance between ink drops to be arranged and the frequency of ink drop discharge determines the recording head scanning speed. Therefore, when the impact distance between ink drops is doubled, the recording head scanning speed can be increased, and the recording duration can be shortened in comparison with the impact distance before division. A short impact distance between ink drops may cause contact therebetween, resulting in blur.

Therefore, with high-resolution recording, it is necessary to decrease the recording speed to prevent blur of ink drops. Dividing record data into two pieces of division record data (first and second plane data) improves the recording speed by increasing the distance between ink drops, which makes blur of ink drops less likely to occur.

Figure 9A:
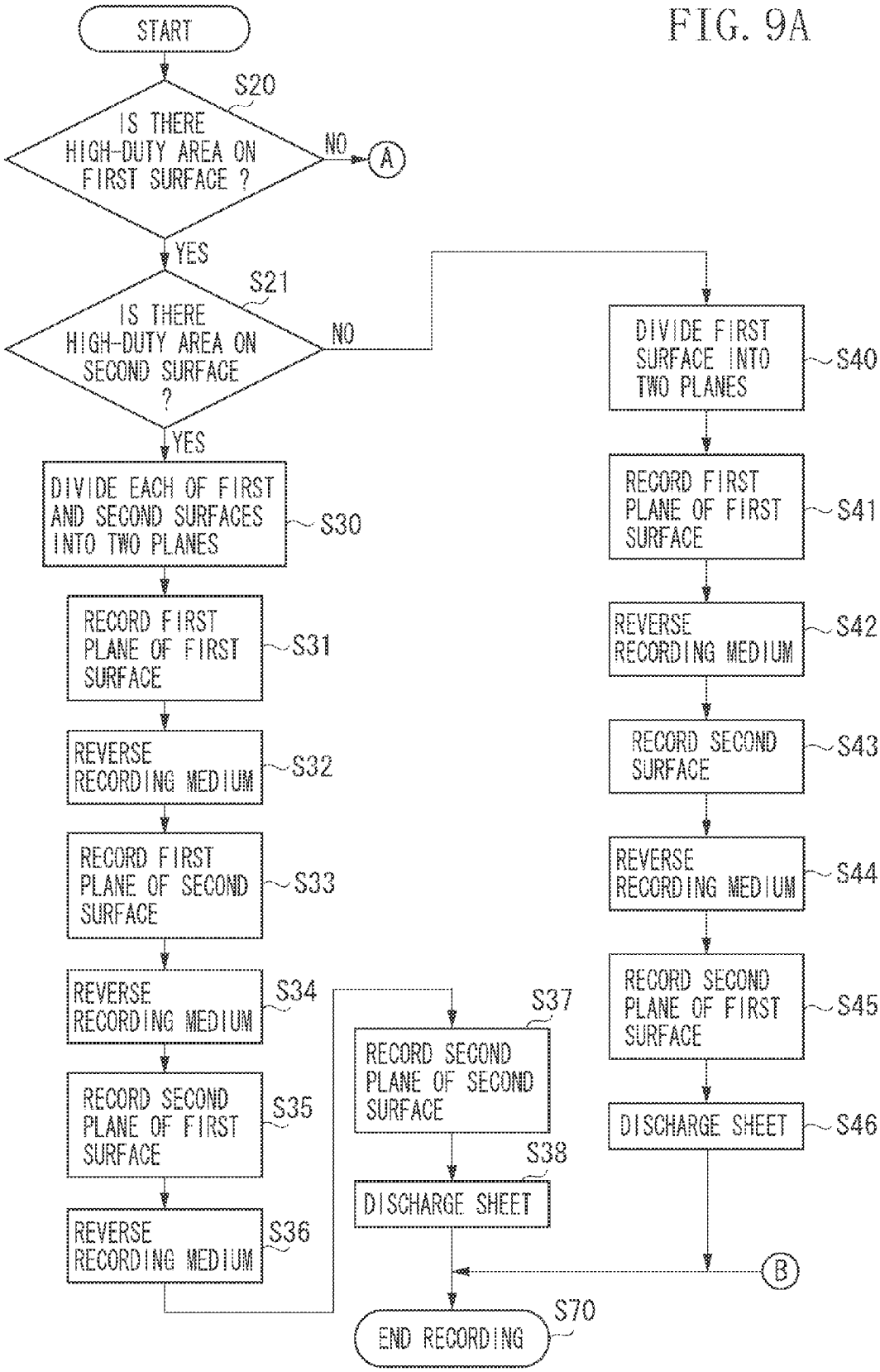
FIGS. 9A and 9B are a flow chart illustrating determination of a high-duty area and the order of recording.
Figure 9B:
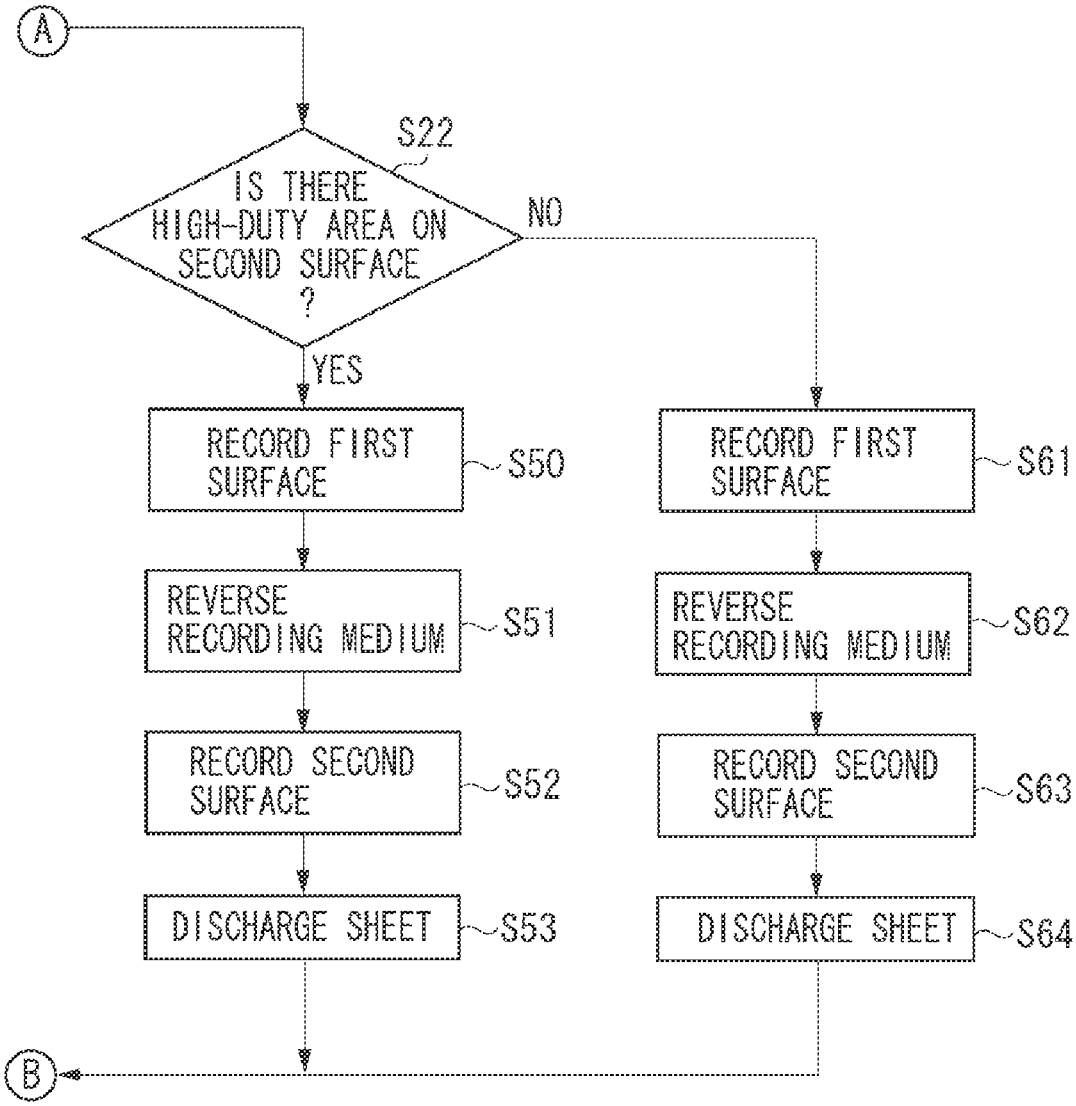

A recording method according to the present example will be described below with reference to FIGS. 9A and 9B. FIGS. 9A and 9B are a flow chart illustrating processing of determining whether there exists a high-duty area on the first and second surfaces of a recording medium, and the subsequent recording sequence.

In step S20, it is determined whether there exists a high-duty area on the first surface. When it is determined that there exists a high-duty area on the first surface (YES in step S20), the processing proceeds to step S21. Otherwise (NO in step S20), the processing proceeds to S22. In step S21, it is determined whether there exists a high-duty area on the second surface. When it is determined that there exists a high-duty area on the second surface (YES in step S21), the processing proceeds to step S30. Otherwise (NO in step S21), the processing proceeds to step S40. Similarly, in step S22, it is determined whether there exists a high-duty area on the second surface. When it is determined that there exists a high-duty area on the second surface (YES in step S22), the processing proceeds to step S50. Otherwise (NO in step S22), the processing proceeds to step S61.

In step S30, since it was previously determined that there exists a high-duty area on both the first and second surfaces, two-sided division recording is newly performed, with which each surface is divided into two planes. Firstly, the record data for the first surface is divided into two (first and second plane data), and similarly the record data for the second surface is divided into two (first and second plane data). In step S31, the first plane data is recorded on the first surface. In step S32, the recording medium P is conveyed to the reversing unit 90 to reverse it.

In step S33, the first plane data is recorded on the second surface. In step S34, the recording medium P is reversed. In step S35, the second plane data is recorded on the first surface. In step S36, the recording medium P is reversed again. In step S37, the second plane data is recorded on the second surface. In step S38, the recording medium P is discharged to the outside of the ink jet recording apparatus 1. Then, the recording process ends.

In this case, the record data for each surface should be divided so that the amount of ink to be discharged for each plane is less than the above-mentioned predetermined amounts of ink that does not cause smear. Specifically, maintaining the duty lower than the predetermined duty that causes smear makes it possible to convey the recording medium P to the reversing conveyance path immediately after recording, without setting a time period for waiting for ink to dry (hereinafter, referred to as ink drying wait time).

In step S40, since it was previously determined that there exists a high-duty area only on the first surface, only the first surface is divided into two planes. In steps S40 to S46, printing is performed in the following order: the first plane data is recorded on the first surface, the recording medium P is reversed, the second surface is recorded, the recording medium P is reversed, the second plane data is recorded on the first surface, and the recording medium P is discharged.

In step S50 to S53, since it was previously determined that there exists a high-duty area only on the second surface in step S50, after the recording on the second surface, the recording medium P is discharged. In this case, since the record data for the first surface includes no high-duty area, smear does not occur even when the recording medium P is reversed after recording on the first surface. Further, after recording on the second surface on which a high-duty area exists, since the recording medium P is discharged without reversing, smear is not likely to occur. In steps S50 to S53, therefore, recording on the first surface, reversing the recording medium P, recording on the second surface, and discharging the recording medium P, are performed in this order. Then, the recording process ends.

In steps S61 to S64, since it was previously determined that there is no high-duty area, the recording on the first surface, reversing the recording medium. P, recording on the second surface, and discharging the recording medium P, are performed in this order. Then, the recording process ends.

Examples of time durations related to the recording method according to the present example will be described below with reference to FIG. 10. "Example of conventional method" denotes a case of conventional two-sided recording. "Example of new method A" denotes a case where a high-duty area, with which smear should be taken into consideration, exists only on the first surface, and one-sided division recording is performed insteps S40 to S46 in the present example. "Example of new method B" denotes a case where a high-duty area exists on both the first and second surfaces, and two-sided division recording is performed in steps S30 to S38 in the present example.

More specifically, "Example of conventional method" denotes a case where two-sided recording is performed without using the disclosed information. In step B1, when a recording command is issued, the sheet feed operation is completed in about 2.5 seconds. In step B2, when sheet feeding is completed and the recording medium P reaches a recording area, recording of data is started. Recording data for size A4 takes about 8 seconds.

With the conventional method, in step B3, after operations related to recording on the first surface are completed, the recording medium conveyance operation is stopped to wait for an ink drying wait time until the ink is fixed and smear would not occur. Although this ink drying wait time is variable with the ink discharge amount, in many cases, several seconds to several ten seconds are set. As an example, an ink drying wait time of 12 seconds is set in the preset example.

When the set ink drying wait time has elapsed, the conveyance operation is restarted to reverse the recording medium P in the reversing unit 90. In step B4, the conveyance operation is restarted, the recording medium P is reversed, and the second surface is conveyed to the recording area. This step takes about 4 seconds. In step B5, recording on the second surface is performed in a similar way to the first surface. The time taken from recording on the second surface to discharging of the recording medium P is 8 seconds. With the processing of steps B1 to B5, conventional two-sided recording takes about 34.5 seconds in total.

The example of new method A and the example of new method B using division recording according to the present example will be described below. In the example of new method A, in step S40 of FIG. 9, since there exists an area having a duty equal to or greater than a predetermined value that may cause smear on the first surface, and therefore the record data for the first surface is divided into two (first and second plane data).

When the recording command is issued, the sheet feed operation (step B1) is completed in about 2.5 seconds. When sheet feeding is completed and the recording medium P reaches the recording area, the first plane data recording on the first surface is started in step B2/step S41 of FIG. 9. In comparison with the example of the conventional method, the recording resolution is lower and blur of discharged ink drops is less likely to occur. Hence, recording data for size A4 takes about 4.5 seconds.

After completion of recording on the first surface, since the ink discharge amount for the first plane data for the first surface is low enough for the occurrence of smear, the processing of waiting for the ink drying is skipped. In other words, the recording medium reversing operation is performed, in step B4/step S42 of FIG. 9, immediately after completion of first plane data recording. The reversing operation is completed in about 4 seconds similar to the example of the conventional method.

Then, recording on the second surface is performed in step B5/step S43 of FIG. 9. Since this surface is not divided, the recording takes about 8 seconds similar to the example of the conventional method.

After completion of recording on the second surface, since the second surface has a duty lower than the predetermined value that may cause smear (step B6 takes 0 seconds), the recording medium reversing operation is started immediately in step B7/step S44 of FIG. 9. The reversing operation is completed in about 4 seconds. Then, when the first surface has been conveyed to the recording area again, second plane data recording is performed on the first surface in step B8/step S45 of FIG. 9.

Similar to the first plane data recording on the first surface, the second plane data recording on the first surface can be completed quickly—e.g., in about 4.5 seconds. With the processing of steps B1 to B8, two-sided recording is completed in about 27.5 seconds. This time duration is shorter than that in the example of the conventional method.

The example of new method B denotes a case where there exists an area having a duty exceeding the predetermined value on both the first and second surfaces. Each of the first and second surfaces is divided into two (first and second) planes. When the recording command is issued, the sheet feed operation in step B1 is completed in about 2.5 seconds.

When sheet feeding is completed and the recording medium reaches the recording area, the first plane data recording is performed on the first surface in step B2/step S31 of FIG. 9. Recording takes about 4.5 seconds similar to the example of new method A. After completion of first plane data recording on the first surface, the processing waiting for the ink drying wait time is skipped (step B3 takes 0 seconds) and immediately the recording medium reversing operation is performed in step B4/step S32 of FIG. 9.

The reversing operation is completed in about 4 seconds similar to the example of the conventional method. Then, the first plane data recording is performed on the second surface in step B5/step S33 of FIG. 9. First plane data recording on the second surface takes about 4.5 seconds similar to first plane data recording on the first surface. After completion of first plane data recording on the second surface, the processing waiting for the ink drying wait time is skipped (step B6 takes 0 seconds), and immediately the recording medium reversing operation is performed in step B7/step S34 of FIG. 9.

The reversing operation is completed in about 4 seconds. Then, when the first surface has been conveyed to the recording area again, the second plane data is recorded on the first surface in step B8/step S35 of FIG. 9. Second plane data recording on the first surface takes about 4.5 seconds similar to the first plane data recording on the first surface.

After completion of second plane data recording on the first surface, the processing waiting for the ink drying wait time is skipped (step B9 takes 0 seconds), and immediately the recording medium reversing operation is started in step B10/step S36 of FIG. 9. The reversing operation is completed in about 4 seconds. When the second surface has been conveyed to the recording area, the second plane data is recorded on the second surface in step B11/step S37 of FIG. 9.

Second plane data recording on the second surface also can be quickly completed in about 4.5 seconds because of division recording. Upon completion of second plane data recording on the second surface, the entire recording process is completed. The recording process from step B1 to step B11 takes 32 seconds, which is shorter than the time duration in the example of the conventional method.

As mentioned above, the present example changes recording control according to the duty of the record data. Specifically, when there exists a high-duty area in the record data to be recorded on the first surface of a recording medium, the record data to be recorded on the first surface is divided to generate division record data. Then, between recordings of two different division record data on the first surface, the recording medium is reversed and recording is performed on the second surface (other surface).

The above-mentioned method allows preventing image failure caused by smear due to semi-dry ink adhering to the inside of the conveyance path and image failure caused by secondary smear due to transfer of ink adhering to the conveyance path to the recording medium. The method also allows shortening the recording duration through two-sided recording, i.e., by dividing the record data having a high-duty area into two areas and conveying the recording medium twice.

By recording based on one division record data, waiting for a predetermined time duration, and recording again based on the other division record data, the method achieves color property and image quality higher than those with recordings at the same time or in a short time even with the same ink discharge amount as the conventional method. Further, the above-mentioned division recording decreases the duty for a single recording, reducing air current generated from the recording head at the time of ink discharge. Thus, the accuracy of ink dot impact can be improved.

A second example will be described below. The first example has the following problem: in the case of successive recording on multiple recording media, when determination of a high-duty area is made for each piece of record data to be recorded on each recording medium, the upper surface differs for each recording medium when discharged.

For example, referring to FIG. 9, the upper surface of the recording medium discharged differs between a case where a high-duty area exists on both the first and second surfaces and a case where a high-duty area exists only on the first surface. Therefore, to eliminate the difference between discharged sheets, the user needs to arrange the discharged recording media to unify the front and rear surfaces.

In the present example, when a high-duty area exists at least on the first surface, the record data to be recorded on both surfaces of the recording medium is divided to perform division recording. Specifically, when the duty of the record data to be recorded on the first surface is high, the record data to be recorded on each of the first and second surfaces is respectively divided into two pieces of data (first and second plane data) regardless of the duty of the record data to be recorded on the second surface.

Referring to the first example illustrated in FIG. 9, when a high-duty area is determined to exist on the first surface (YES in step S20), the processing of determination in step S21 is skipped, and the processing proceeds to steps S30 to S38.

The above-mentioned processing allows preventing smear and shortening the recording duration, which are effects of the first example. Further, the processing also makes it unnecessary for the user to rearrange the front and rear surfaces after discharge since the second surface is constantly recorded last.

In the first and second examples, it is desirable to set a relatively small dot count area W in determining a high-duty area based on the dot count. This is because, depending on a positional relation between the recording area R to be actually recorded and the dot count area W, even a high-duty area produces a low recording ratio possibly resulting in a detection error.

Therefore, a smaller size of the dot count area W makes a detection error less likely to occur, improving the detection accuracy. Since the fixing characteristics are comparatively favorable even when a detection error occurs, smear is not likely to occur. The dot count area W can be made smaller by using a method for dividing the recording head in the nozzle column direction and counting the number of dots to be recorded and a method for shortening interruption intervals.

On the other hand, a too small dot count area W may cause an inconvenience that an area having a low recording ratio, such as text, is detected as a high-duty area.

Therefore, the size of the dot count area W may be preferably determined in a comprehensive way, considering the above-mentioned situations. A technique suitable for avoiding the above-mentioned inconvenience occurring with a too small dot count area W includes: accumulating the result of detection of adjacent dot count areas W; and determining whether the recording ratio of the dot count areas W is high or low based on the accumulation value.

In the present example, as illustrated in FIG. 6A, each area formed by dividing the entire area of one surface of a recording medium both in the main scanning direction (horizontal direction) and the sub scanning direction (vertical direction) as a unit area subjected to dot counting.

The disclosed information is not limited to this division method. For example, each division area formed by dividing the entire area of one surface of the recording medium only in the main scanning direction (horizontal direction) may be defined as a unit area (dot count area W). Further, each division area formed by dividing the entire area of one surface of the recording medium only in the sub scanning direction (vertical direction) may be defined as a unit area (dot count area W).

However, as mentioned above, since a smaller size of the unit area (dot count area W) is preferable from the viewpoint of smear prevention, division in both the main scanning direction and the sub scanning direction is desirable.

The number of dots to be recorded in the unit area and the recording ratio (recording duty) therein are applicable as information for determining whether a high-duty area exists, that is, information about the amount of ink to be discharged to the unit area. In addition to this indirect information, information about the amount of ink to be discharged converted therefrom, i.e., direct information about the amount of ink to be discharged may be used.

As mentioned above, in the disclosed information, information about the number of dots recorded, information about the recording ratio (recording duty), or direct information about the amount of ink to be discharged is applicable as information about the amount of ink to be discharged to the unit area (for example, the dot count area W). Further, a method for determining the first surface and a method for determining the second surface may be performed separately, and a first method for determining the first surface and a second method for determining the second surface may be provided separately.

Although the first and second examples have specifically been described based on a method for changing recording control according to the ink discharge amount to be recorded on a recording medium based on the dot count, the disclosed information is not limited thereto.

Generally, the printer driver 103 generates record data according to a drawing command from the OS 102, and transmits the data to the printer 105. In this case, the drawing command includes attribute data corresponding to the attribute of each piece of record data, such as characters (character thin lines), graphics, and photographs (images). It is possible to perform control for determining whether the division recording is performed according to the type of the attribute data.

Figure 11:
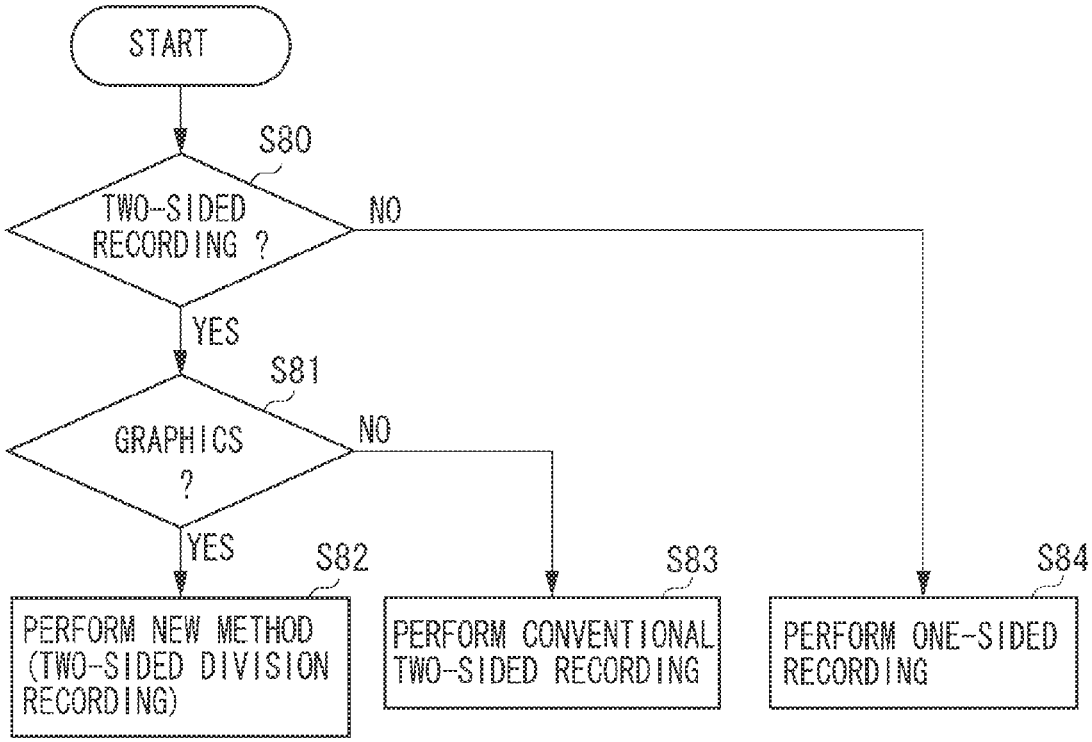
FIG. 11 is a flow chart illustrating processing for selecting a recording method based on attribute data.

FIG. 11 illustrates an example of processing for determining a recording method. In the case of two-sided recording, when the drawing command includes a graphic drawing command highly likely to involve a high-duty area, the record data is divided for recording. This determination method based on the attribute data takes shorter time than the dot-count-based determination method in the above-mentioned examples for determining whether there exists a recording duty exceeding the predetermined value based on the dot count.

Since graphic drawing commands can be classified into line drawing commands for such graphics as graphs, and bitmap drawing commands for such bitmap as photographs, the determination method may be selected taking these commands into consideration. For example, when the drawing command includes a line drawing command, division recording according to the disclosed information is performed since a high-duty area having a large amount of ink to be discharged may be recorded. When the drawing command includes a bitmap drawing command, a histogram regarding the luminance of the relevant bitmap image is generated, and whether division recording is to be performed based on the density of the image to be drawn.

Further, recording control can be changed according to the position of the graphic drawing command within the print page. For example, when the top half of the page includes a graphic drawing command and the bottom half thereof includes a character drawing command, a sufficient ink drying time can be ensured for the first half page while recording on the last half page is being performed. In this case, the conventional recording control may be optionally selected.

The printer driver or by the printer may generate the attribute data. When generated by the printer, the printer may make the above-mentioned graphic determination. This drawing-command-based determination method can be used together with the dot-count-based determination method in the above-mentioned examples. For example, the determination method may include: determining whether the drawing command includes a graphic drawing command; performing division recording when the drawing command includes a graphic drawing command; and determining whether division recording depending on the result of the dot-count-based determination, otherwise.

Further, the determination method for determining whether the record data includes a high-duty area may include: defining a predetermined threshold value in multi-valued record data, and performing division recording assuming that a gradation value exceeding the threshold value is a high-duty area having a large amount of ink to be discharged. This method also can be used together with the dot-count-based determination method and the drawing-command-based determination method. Further, when there are more than one ink characteristics (for example, pigment and dye), determination may be made for each ink type. In this case, division recording according to the disclosed information may be performed when any certain ink exceeds a predetermined condition.

Further, the division method is not limited to the above-mentioned column thinning-out, but may be random-pattern or staggered-pattern masking. Further, a low-duty area to be subjected to an ink discharge amount below a predetermined amount may not be divided and recording is performed with one plane, only a high-duty area to be subjected to an ink discharge amount equal to or greater than the predetermined amount may be divided into two planes.

For example, discharging an amount of ink below a predetermined amount for all unit areas performs image recording on one plane and discharging the remaining amount of ink to the high-duty area performs image recording on the other plane.

This method allows dividing only a high-duty area into two (first and second) planes, preventing image failure due to a conveyance error caused by the recording medium reversing operation and scanning operations. Further, although the record data is divided into two planes in the present example, the number of planes included in pieces of division record data is not limited to two, but may be changed according to the time duration necessary for scanning operations for recording.

Although the recording medium is fed to the reversing conveyance path immediately after completion of recording in the present example, the ink drying time may be set according to the recording duty after division as long as it is shorter than the ink drying time at the time of high-duty recording.

Further, in the above-mentioned examples, a program for achieving these functions may be stored in a recording medium, and the program may be loaded therefrom as a code to a computer and the computer executes it. The recording medium is a computer-readable recording medium. Here, the computer-readable medium may have stored thereon, a program that may cause an ink jet recording apparatus to perform a method disclosed herein.

The program itself as well as the recording medium storing the program therein is included in the above-mentioned examples. Such recording media may be, for example, a floppy (registered trademark) disk, a hard disk, an optical disk, a magneto-optical disk, a compact disk ROM (CD-ROM), a magnetic tape, a nonvolatile memory card, and a ROM. The computer-readable medium may be non-transitory.

Further, the processing of the above-mentioned examples may be executed not only by the single program stored in the recording medium, but also through a collaboration with other software and extension board functions under the control of the operating system. Further, the disclosed information may be presented as an ink jet recording system including a control apparatus for controlling an ink jet recording apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-201476 filed Sep. 1, 2009, which is hereby incorporated by reference herein in its entirety.

What is claimed is:

1. An ink jet recording apparatus for two-sided recording by discharging ink from a recording head to first and second surfaces of a recording medium, the ink jet recording apparatus comprising:

a conveyance unit configured to convey the recording medium to reverse front and rear surfaces of the recording medium to allow the two-sided recording;

a determination unit configured to determine, for each of a plurality of unit areas formed by dividing the first surface, whether an amount of ink to be discharged to each unit area is equal to or greater than a predetermined amount; and a control unit configured to control the conveyance unit and the recording head, wherein the control unit controls the conveyance unit and the recording head to discharge to a unit area, determined to be subjected to an ink discharge amount equal to or greater the predetermined amount by the determination unit, an amount of ink below the predetermined amount corresponding to a part of the amount of ink to be discharged to the unit area, thereafter to move the recording medium reversely so that the second surface faces the recording head, then to move the recording medium reversely, and to discharge a remaining part of the amount of ink to the unit area that has been subjected to an ink discharge amount below the predetermined amount.

2. The ink jet recording apparatus according to claim 1, wherein the predetermined amount differs for each position of the recording medium.

3. An ink jet recording apparatus for two-sided recording by discharging ink from a recording head to first and second surfaces of a recording medium, the ink jet recording apparatus comprising:

a conveyance unit configured to convey the recording medium to reverse front and rear surfaces of the recording medium to allow the two-sided recording;

a first determination unit configured to determine, for each of a plurality of first unit areas formed by dividing the first surface, whether a first amount of ink to be discharged to each first unit area is equal to or greater than a predetermined amount;

a second determination unit configured to determine, for each of a plurality of second unit areas formed by dividing the second surface, whether a second amount of ink to be discharged to the each second unit area is equal to or greater than a the predetermined amount; and a control unit configured to control the conveyance unit and the recording head, wherein, in a case where both the first and second determination units determine that each of the first and second unit area is to be subjected to an ink discharge amount equal to or greater than the predetermined amount, the control unit controls the conveyance unit and the recording head to perform discharging to a unit area of the first surface, determined to be subjected to an ink discharge amount equal to or greater the predetermined amount by the first determination unit, an amount of ink below the predetermined amount corresponding to a part of the amount of ink to be discharged to the unit area of the first surface, then reversing the recording medium, and discharging to a unit area of the second surface, determined to be subjected to an ink discharge amount equal to or greater the predetermined amount by the second determination unit, an amount of ink below the predetermined amount corresponding to a part of the amount of ink to be discharged to the unit area of the second surface, reversing the recording medium, and discharging a remaining part of the amount of ink to the unit area of the first surface that has been subjected to an ink discharge amount below the predetermined amount, and reversing the recording medium, and discharging a remaining part of the amount of ink to the unit area of the second surface that has been subjected to an ink discharge amount below the predetermined amount.

4. An ink jet recording apparatus for two-sided recording by discharging ink from a recording head to first and second surfaces of a recording medium, the ink jet recording apparatus comprising:

a conveyance unit configured to convey the recording medium to reverse front and rear surfaces of the recording medium to allow the two-sided recording;

a determination unit configured to determine, for each of a plurality of unit areas formed by dividing each of the first and second surfaces, whether the duty of record data corresponding to an image to be recorded on the each unit area is equal to or greater than a predetermined value;

a division unit configured to divide the record data corresponding to a unit area determined to have a duty equal to or greater than the predetermined value into groups of division record data; and a control unit configured to control the conveyance unit and the recording head according to the result of determination by the determination unit, wherein, in a case where the determination unit determines that there exists a unit area having a duty equal to or greater than the predetermined value both on the first and second surfaces, the control unit controls the conveyance unit and the recording head to perform recording on the first surface a part of the image to be recorded thereon according to a first group of division record data for the first surface divided by the division unit, reversing the recording medium, and recording on the second surface a part of the image to be recorded thereon according to a second group of division record data for the second surface divided by the division unit, reversing the recording medium, and recording on the first surface a remaining part of the image to be recorded thereon according to the first group of division record data for the first surface; and reversing the recording medium, and recording on the second surface a remaining part of image to be recorded thereon according to the second group of division record data for the second surface.

5. The ink jet recording apparatus according to claim 4, wherein, in a case where the determination unit determines that there exists a unit area having a duty equal to or greater than the predetermined value on the first surface and there does not exist a unit area having a duty at least equal to the predetermined value on the second surface, the control unit controls the conveyance unit and the recording head to perform recording on the first surface apart of the image to be recorded thereon according to the first group of division record data for the first surface divided by the division unit, reversing the recording medium, and recording on the second surface the image to be recorded thereon, reversing the recording medium, and recording on the first surface a remaining part of the image to be recorded thereon according to the first group of division record data for the first surface.

6. An ink jet recording apparatus for two-sided recording by discharging ink from a recording head to first and second surfaces of a recording medium, the ink jet recording apparatus comprising:

a conveyance unit configured to convey the recording medium to reverse front and rear surfaces of the recording medium to allow the two-sided recording;

a determination unit configured to determine, for each of a plurality of unit areas formed by dividing each of the first and second surfaces, whether an amount of ink to be discharged to each unit area is equal to or greater than a predetermined amount; and a control unit configured to control the conveyance unit and the recording head, wherein, in a case where the determination unit determines that the unit area of the first surface is to be subjected to an ink discharge amount equal to or greater than the predetermined amount, the control unit controls the conveyance unit and the recording head to perform discharging to a unit area of the first surface, determined to be subjected to an ink discharge amount equal to or greater the predetermined amount by the first determination unit, an amount of ink below the predetermined amount corresponding to a part of the amount of ink to be discharged to the unit area of the first surface, reversing the recording medium, discharging to a unit area of the second surface an amount of ink below the predetermined amount corresponding to a part of the amount of ink to be discharged to the unit area of the second surface, reversing the recording medium, and discharging a remaining part of the amount of ink to the unit area of the first surface that has been subjected to an ink discharge amount below the predetermined amount, reversing the recording medium, and discharging a remaining part of the amount of ink to the unit area of the second surface that has been subjected to an ink discharge amount below the predetermined amount.

7. An ink jet recording system including an ink jet recording apparatus and a control apparatus for controlling the ink jet recording apparatus, the ink jet recording system comprising:

a conveyance unit configured to convey the recording medium to reverse front and rear surfaces of the recording medium to allow the two-sided recording;

a determination unit configured to determine, for each of a plurality of unit areas formed by dividing the first surface, whether an amount of ink to be discharged to each unit area is equal to or greater than a predetermined amount; and a control unit configured to control the conveyance unit and the recording head to perform discharging to a unit area, determined to be subjected to an ink discharge amount equal to or greater the predetermined amount by the determination unit, an amount of ink below the predetermined amount corresponding to a part of the amount of ink to be discharged to the unit area, reversing the recording medium so that the second surface faces the recording head, and discharging a remaining part of the amount of ink to the unit area that has been subjected to an ink discharge amount below the predetermined amount.

* * * * *